US005915476A

United States Patent [19]

Hubbell et al.

[11] Patent Number: 5,915,476

[45] Date of Patent: Jun. 29, 1999

[54] MONITORING WELL

[75] Inventors: Joel M. Hubbell; James B. Sisson, both of Idaho Falls, Id.

[73] Assignee: Lockheed Martin Idaho Technologies Company, Idaho Falls, Id.

[21] Appl. No.: 08/786,508

[22] Filed: Jan. 21, 1997

[51] Int. Cl.[6] ..... E21B 47/00

[52] U.S. Cl. ..... 166/113; 166/205

[58] Field of Search ..... 166/113, 250.01, 166/250.15, 65.1, 254.1, 64, 205

[56] References Cited

U.S. PATENT DOCUMENTS

| | | | |
|---|---|---|---|
| 2,335,558 | 11/1943 | Young | 166/228 |
| 2,905,251 | 9/1959 | Church | 166/228 |
| 3,173,488 | 3/1965 | Rensvold | 166/228 |
| 3,268,001 | 8/1966 | Brandt | 166/228 |
| 4,917,183 | 4/1990 | Gaidry et al. | 166/228 X |
| 5,295,538 | 3/1994 | Restarick | 166/205 |
| 5,318,119 | 6/1994 | Lowry et al. | 166/228 |

*Primary Examiner*—Frank Tsay
*Attorney, Agent, or Firm*—Wells St John Roberts Gregory & Matkin

[57] ABSTRACT

A monitoring well including a conduit defining a passageway, the conduit having a proximal and opposite, distal end; a coupler connected in fluid flowing relationship with the passageway; and a porous housing borne by the coupler and connected in fluid flowing relation thereto.

20 Claims, 4 Drawing Sheets

MONITORING WELL

CONTRACTUAL ORIGIN OF THE INVENTION

The United States Government has rights in this invention pursuant to Contract No. DE-AC07-94ID13223 between Lockheed Martin Idaho Technologies Company and the United States Department of Energy.

TECHNICAL FIELD

This invention relates to monitoring wells, and more specifically to a vadose monitoring well which is useful for determining soil conditions in below-grade earthen soil.

BACKGROUND OF THE INVENTION

Various devices have been designed and manufactured over time and which are useful when used in an earthen profile to determine or calculate hydraulic gradients. These hydraulic gradients have been employed to determine the direction of water movement and to estimate water flux using unsaturated hydraulic conductivity. As should be understood, the movement of water in an unsaturated earthen zone is important for engineering studies, hazardous waste site monitoring, recharge studies and irrigation management practices. For example, if the moisture potential of soil can be accurately monitored, irrigation can be controlled to optimize the rate of plant growth.

One type of instrument used heretofore for measuring soil moisture potential is the tensiometer. A conventional tensiometer comprises a sealed tube defining a chamber which is normally completely filled with water; a hollow porous tip on one end of the tube; and a vacuum gauge connected to the water chamber. The porous tip is inserted in the soil and establishes liquid contact between the water in the tube and the moisture in the soil surrounding the tip. Relatively dry soil tends to pull water from the tube through the porous tip. However, since the tube is sealed, only a minute amount of water is actually withdrawn. Accordingly, the water in the tube is placed under tension by the pulling effect of the dry soil, thus creating a measurable subatmospheric pressure in the tube. Higher moisture contents in the soil produce correspondingly less vacuum in the tube, and completely saturated soils register substantially zero vacuum or atmospheric pressure.

Conventional tensiometers have been installed, generally, within a few meters of the land surface because the length of the water column employed with same will determine, to some degree, the accuracy of the tensiometer. In this regard, it should be understood that there is a physical limit to the length of the column of water which can be supported by atmospheric pressure (about 1,020 centimeters at sea level) and the useful measurement range of the tensiometer is reduced as the column of water above the porous tip is lengthened. In this regard, the pressure exerted by the column of water increases the pressure in the porous tip, which in turn increases the apparent soil moisture tension recorded by the above-surface pressure measuring devices employed with same.

Conventional tensiometers may be constructed with pressure transducers buried at or near the sensing tip to circumvent this depth limitation and allow automated data collection. While this design operates with some degree of success, it has shortcomings which have detracted from its usefulness. For example, this design does not allow for periodic calibration of the transducer, replacement of the transducer, or refilling of the instrument. Others skilled in the art have attempted to avoid this perceived shortcoming by designing air filled tensiometers and utilizing various measurement practices to address the shortcomings associated with same. All these practices have met with limited success.

There remains a need, therefore, for a monitoring well which can be utilized in combination with various geophysical, and hydrogeologic monitoring devices and which is operable to measure various soil parameters such as moisture potential deep within sub-grade earthen soil. Although the principal motivation for this invention arose from concerns associated with deep soil use of tensiometers, those artisans skilled in this field will recognize other inventive uses of the invention which is only to be limited by the accompanying claims appropriately interpreted in accordance with the Doctrine of Equivalents.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
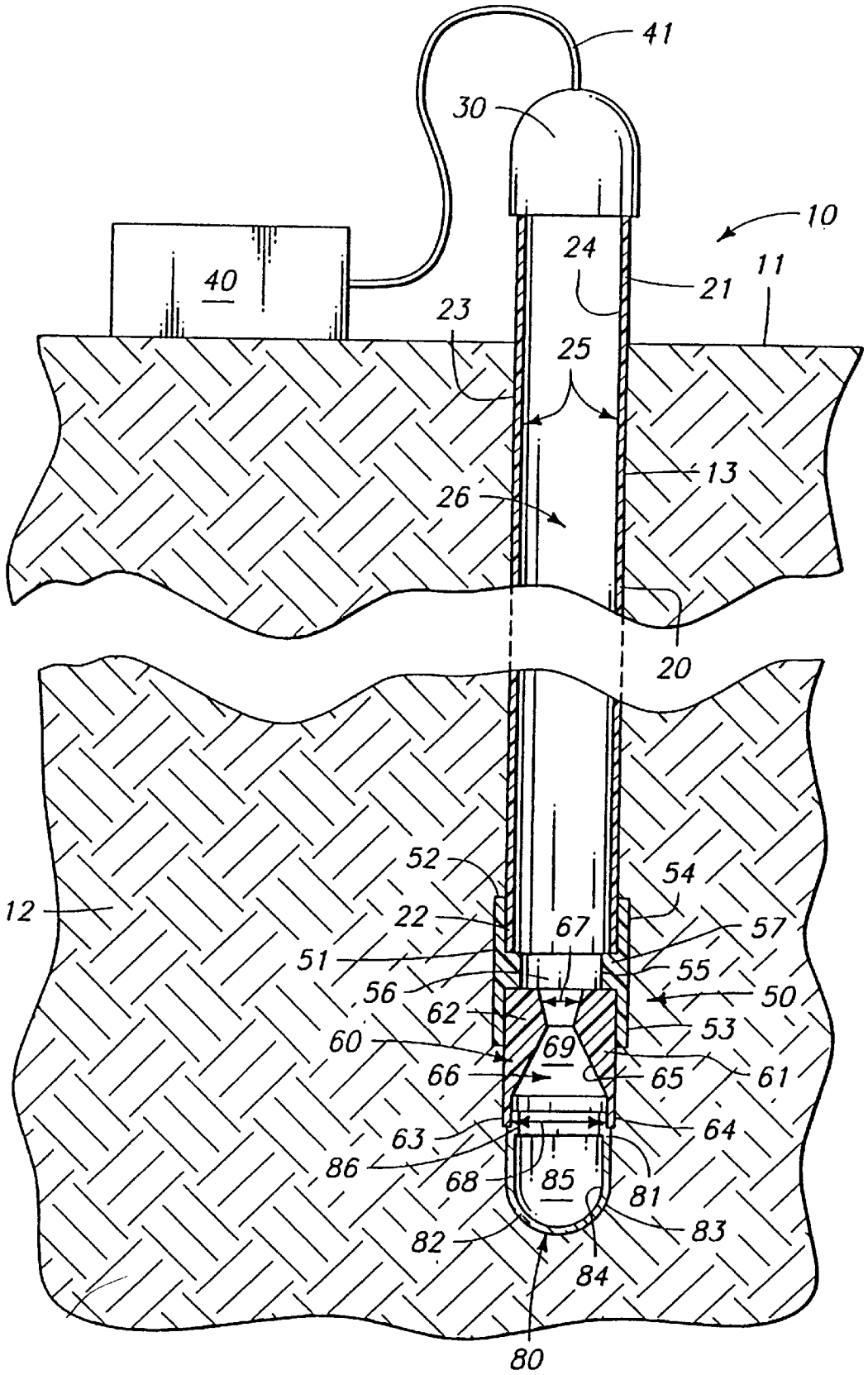
FIG. 1 is a longitudinal, transverse, vertical sectional view of the monitoring well of the present invention.

Referring now to FIG. 1, a monitoring well in accordance with one aspect of the invention is indicated generally by reference to the numeral 10. As shown therein, the monitoring well 10 is buried below the surface of the earth 11 in a below grade portion 12. A bore hole 13 of suitable dimensions receives the monitoring well 10. As shown in FIG. 1, the monitoring well 10 includes a conduit 20 which is received in the bore hole 13 and which has a proximal end 21 and an opposite, distal end 22. As will be recognized, the conduit is substantially uniformly linear, and the proximal end 21 extends above the surface of the earth 11 thereby allowing convenient access to same. Further, the conduit is oriented in a substantially nonhorizontal orientation relative to the surface of the earth 11. In particular, the conduit is oriented in such a fashion that the distal end is located at a lower elevation with respect to the proximal end. The conduit 20 has an outside surface 23, and an inside surface 24 which defines a given inside diametral dimension 25. While the conduit is shown as a uniformly cylindrical tube, or pipe, the conduit may be fabricated in a fashion to include a reduced diameter portion adjacent the distal end. The significance of this feature will be discussed in greater detail hereinafter. A surface cap 30 realizable engages the proximal end 21. A data logging device 40 is positioned remotely relative to the monitoring well 10 and includes an electrical conduit 41 which is received through the surface cap 30 and is electrically coupled with a geophysical monitoring device which will be discussed in greater detail hereinafter.

The monitoring well 10 of the present invention includes a sleeve which is generally designated by the numeral 50. The sleeve 50 telescopingly mates with the distal end 22 of the conduit 20. The sleeve 50 has a main body 51 which has a first end 52, and an opposite second end 53. Further, the main body has an outside surface 54, which defines an outside diameter and which is greater than the outside diameter of the conduit 20. The main body 51 has an inside surface 55 which defines a passageway 56. As will be recognized, the inside diameter of the passageway 56, has an inside diametral dimension which is greater than an outside diameter of the conduit 20. This facilitates the telescoping mating receipt of the distal end 22 of the conduit 20 therewithin. An annular ring 57 is disposed intermediate the first and second ends 52 and 53, respectively. The annular ring 57 defines a reduced diametral portion of the main body 51.

As best seen in FIG. 1, the monitoring well 10 of the present invention includes a coupler 60 which has a main body 61. The main body 61 has a first end 62, and an opposite, second end 63. Further, the main body has an outside surface 64 and an inside surface 65. The outside surface defines an outside diameter which facilitates the telescoping receipt of same in the passageway 56 which is defined by the second end 53 of the sleeve 50. Further, the inside surface 65 defines a passageway 66 which has variable diametral dimension. For example, passageway 66 at the first end 62 has a first diametral dimension 67, and the passageway 66 at the second end 63 has a second diametral dimension 68 which is greater than the first diametral dimension. Further, the passageway intermediate the first and second ends has an increasing diametral dimension when measured at intervals extending from the first to the second ends. As seen in FIG. 1, the passageway defines a reservoir 69 which is disposed intermediate the opposite first and second ends. The passageway 66 is positioned in fluid flowing communication with the passageway 56 and with the conduit 20. As seen in FIG. 1, the passageway 66 at the first end 62 has a tapered configuration, as shown.

As will be recognized from the drawings, the second end of the sleeve 53 telescopingly receives the first end 62 of the coupler 60. However, it is possible, that the sleeve, and coupler, may be combined into a single assembly as compared with the two discrete elements as shown herein. The sleeve and coupler may be manufactured from any rigid, fluid impermeable and oxidation resistent material such as stainless steel, polyvinyl cloride, and the like. Still further, and as was discussed above, the conduit may be fabricated with a reduced diameter portion similar to that provided by the first end 62 of the coupler 60. If this is provided, the sleeve and coupler, as shown herein, would not be necessary and could be eliminated.

A porous housing 80 is mounted in fluid flowing communication with the second end 63 of the coupler 60. In this regard, the porous housing 80 comprises a ceramic cup of conventional design and which is well known to those skilled in the art. The porous housing permits the movement of fluids into and out of same. The porous housing 80 has a first end 81, and an opposite second end 82. Further, the porous housing has an outside surface 83, which defines an outside diametral dimension. The porous housing 80 further has an inside facing surface 84 which defines a chamber 85. An annular ring 86 is mounted on the first end 81, and defines a seat which facilitates the telescoping mating receipt of the first end 81 in the passageway 66, which is defined by the coupler 60. The porous housing 80 is secured in place by a suitable fastening means such as adhesives, threaded fasteners, and the like.

The monitoring well 10 of the present invention is operable to work in combination with various geophysical monitoring devices which are operable to determine various sub-grade soil parameters. In this regard, and referring more particularly to FIG. 2, a first type of geophysical monitoring device is illustrated as a transducer 110. The transducer 110 has a first end 111, and an opposite second end 112. A resilient connector 113, which is manufactured from a natural, or synthetic polymeric based material, is received about the second end 112, and fluid sealably connects the transducer 110 to the coupler 60 at the first end thereof. As illustrated, the resilient connector has a passageway 113A formed therein. The resilient connector 113 is substantially frusto-conically shaped, however, it is conceivable that other shapes which facilitate the releasable fluid sealing engagement of the geophysical, or hydrogeological monitoring device to the coupler 60 will work with equal success. The electric conduit 41 is electrically coupled to the first end 111, and is operable to transmit electrical data to the data logging device 40 which is positioned on the earth's surface 11. The transducer 110 has an outside diametral dimension which is less than the inside diametral dimension of the conduit 20. As such, the transducer 110 can travel, under the influence of gravity, from the proximal end 21, in the direction of the distal end 22. The weight of the transducer 110 is normally sufficient to fluid sealingly mate the second end 112 with the coupler 60. Further, the present design facilitates the removal of the transducer and the replacement or calibration of same if malfunction occurs because it can be easily disengaged from the coupler 60 and retrieved to the earth's surface for the subsequent repair, replacement, or calibration by suitable retrieving means.

Figure 2:
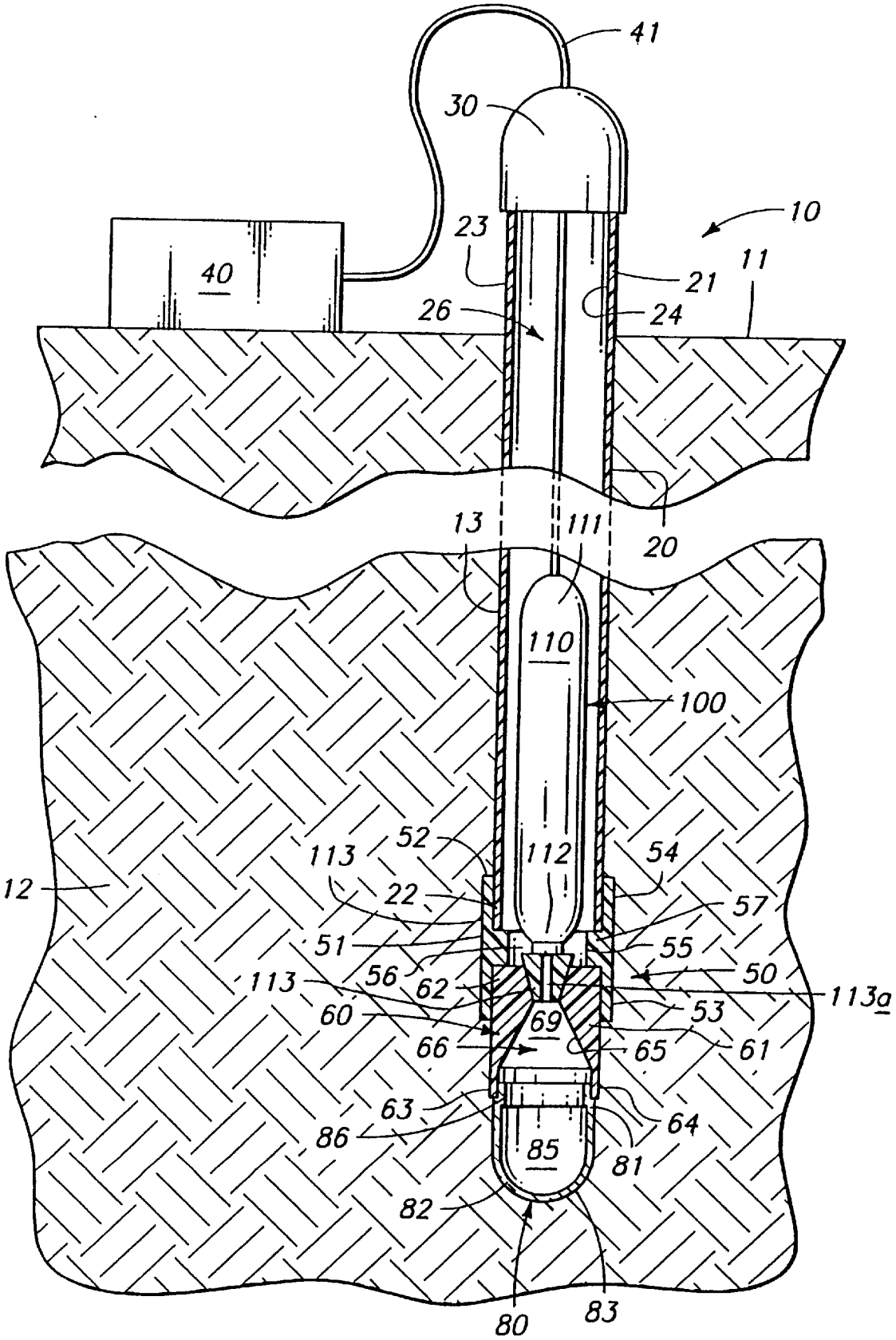
FIG. 2 is a longitudinal, traverse, vertical sectional view of the monitoring well of the present invention, and a geophysical or hydrogeologic monitoring device employed with same.
Figure 6:
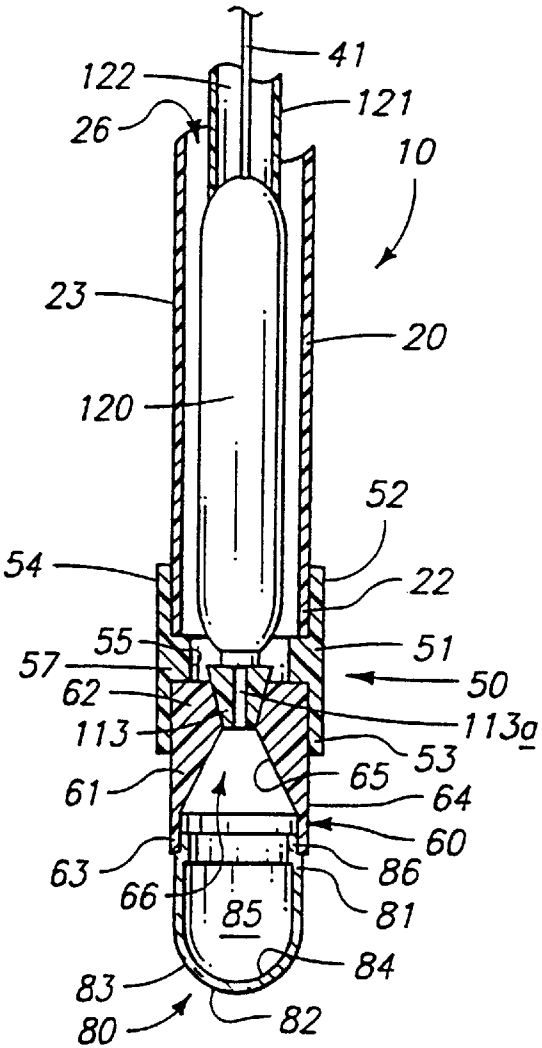
FIG. 6 is a longitudinal, transverse, vertical sectional view of the monitoring well of the present invention, and a fifth type of geophysical or hydrogeologic monitoring device employed with same.

A second type of the geophysical or hydrogeological monitoring device 100 is shown by reference to numeral 120 in FIG. 6. As shown therein, a transducer of substantially identical design to that shown at 110 in FIG. 2, is illustrated. However, in this view, a guide tube 121 is mounted on same. The guide tube defines a passageway 122. As should be understood, the guide tube permits an operator, not shown, to precisely position the transducer into interfitted mating receipt with the coupler 60, and further to exert given amounts of force to same. The electrical conduit 41 is received in the passageway 122, and extends to the surface of the earth 11.

Figures 3, 4, 5:
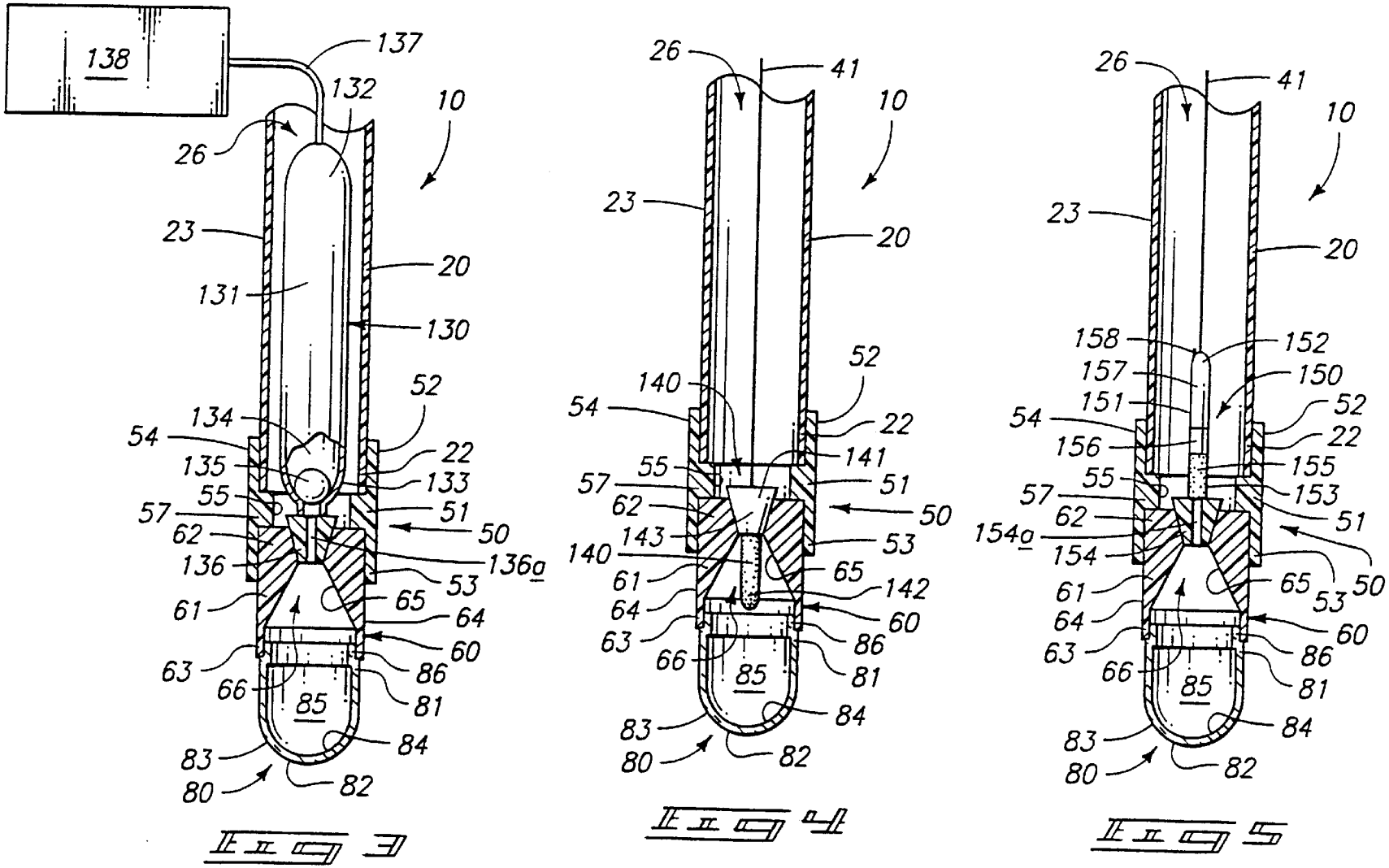
FIG. 3 is a longitudinal, transverse, vertical sectional view of the monitoring well of the present invention, and a second type of geophysical or hydrogeologic monitoring device employed with same.
FIG. 4 is a longitudinal, transverse, vertical sectional view of the monitoring well of the present invention, and a third type of geophysical or hydrogeologic monitoring device employed with same.
FIG. 5 is a longitudinal, transverse, vertical sectional view of the monitoring well of the prevent invention, and a fourth type of geophysical or hydrogeologic monitoring device employed with same.

A third type of the geophysical monitoring device which may be utilized with the monitoring well 10 of the present invention includes a moisture sampling device and which is generally indicated by the numeral 130, in FIG. 3. The moisture sampling device 130 has a main body 131, and opposite first, and second ends, 132 and 133 respectively. The main body 131 defines a chamber 134 which includes a check valve 135. The check valve 135 provides a means by which fluids can move in a single direction into the chamber 134. The check valve 135 is located at the second end 133 of the main body. A resilient connector 136 is similarly received about the second end and provides a means by which the moisture sampling device 130 can fluid sealably engage the coupler 60. The resilient coupler has a passageway 136A formed therein. As shown in FIG. 3, a vacuum/access tube 137 is disposed in fluid communication with the first end 132, and the chamber 134. A vacuum pump 138 is disposed in fluid flowing relation to the vacuum/access tube 137 and provides a means by which moisture from the surrounding earthen environment may be urged through the porous housing 80, the coupler 60, past the check valve, and into the chamber 134. The fluid may then be retrieved to the surface of the earth. As should be understood, this same tube, 137 may extend through the resilient connector and be located in the chamber 85. In this arrangement, the check valve 135 would be eliminated.

A fourth type of geophysical monitoring device 100 is best seen by reference to FIG. 4, and includes a vapor sampling device 140. The vapor sampling device has a first end 141 and an opposite second end 142. A resilient connector 143 is operable, as was described earlier with the other forms of the geophysical monitoring devices, to fluid sealably connect the vapor sampling device to the coupler 60. As illustrated in FIG. 4, the vapor sampling device is received in the passageway 66 which is defined by the main body 61 of the coupler 60. The conduit 41 is coupled with the vapor sampling device, and is used to raise and cover same to the earth's surface 11. The vapor sampling device samples the vapors resident in the reservoir portion of the coupler 60, the vapors having migrated through the porous housing 80 and into the chamber 85 of same. Alternatively, the sampling device can be a passive substance, such as activated carbon, which can be subsequently returned to the earth's surface for latter analysis.

A fifth type of geophysical or hydrogeologic monitoring device is shown in FIG. 5, and includes an advective vapor sampling device 150. These devices are employed to detect volatile organic contaminants (VOC's). The advective vapor sampling device has a main body 151 which has a first end 152, and an opposite second end 153. The first end 152 is electrically coupled to the data logging device 40 which is positioned on the earth's surface, not shown, by means of the conduit 41. The second end 153 is mounted on the resilient connector 154 thereof, and which operates in the fashion as earlier described. A passageway 154A is formed in the resilient connector. The second end 153 further includes a desiccant/absorbent portion which is mounted in fluid flowing relation relative to a pump assembly 156 of conventional design. The advective vapor sampling assembly 150 further has a battery 157 which powers the pump 156, and a vent 158 is provided for same. Alternatively, the pump can be powered from the earth's surface, or the pump mounted on the earth's surface and connected in fluid flowing relation to the sampling or monitoring device 150.

Figure 7:
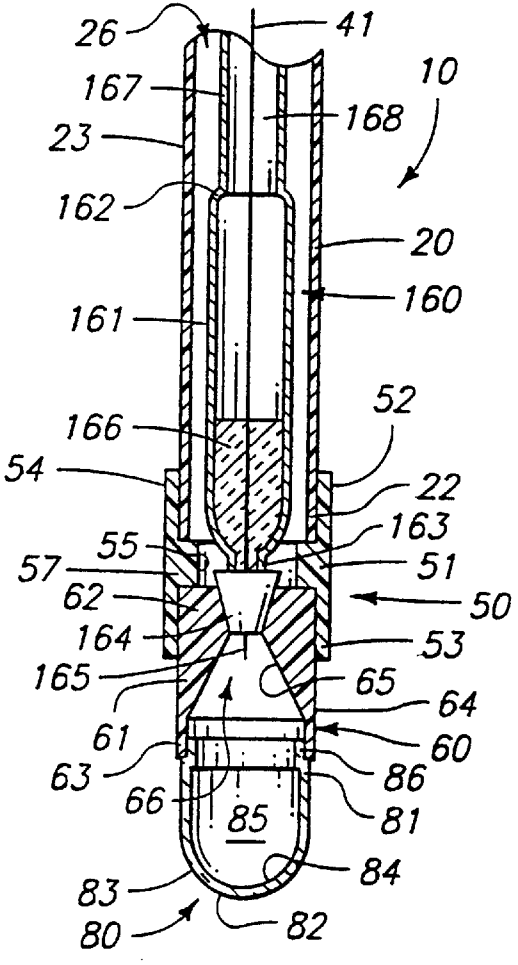
FIG. 7 is a longitudinal, transverse, vertical sectional view of the monitoring well of the present invention, and a sixth type of geophysical or hydrogeologic monitoring device employed with same.

A sixth type of geophysical monitoring device is shown in FIG. 7 and comprises a thermocouple psychrometer 160. The sixth type of device 160 has a main body 161 with a first end 162, which is electrically coupled to the electrical conduit 41, and an opposite second end 163. A resilient connector 164, as was discussed earlier, is connected thereto. A sensing element 165 extends into the passageway defined by the coupler 60. The thermocouple psychrometer 160 has an insulation portion 166 and a guide tube 167 is connected to the first end thereof. The guide tube defines a passageway 168 in which the conduit 41 is enclosed.

Figure 8:
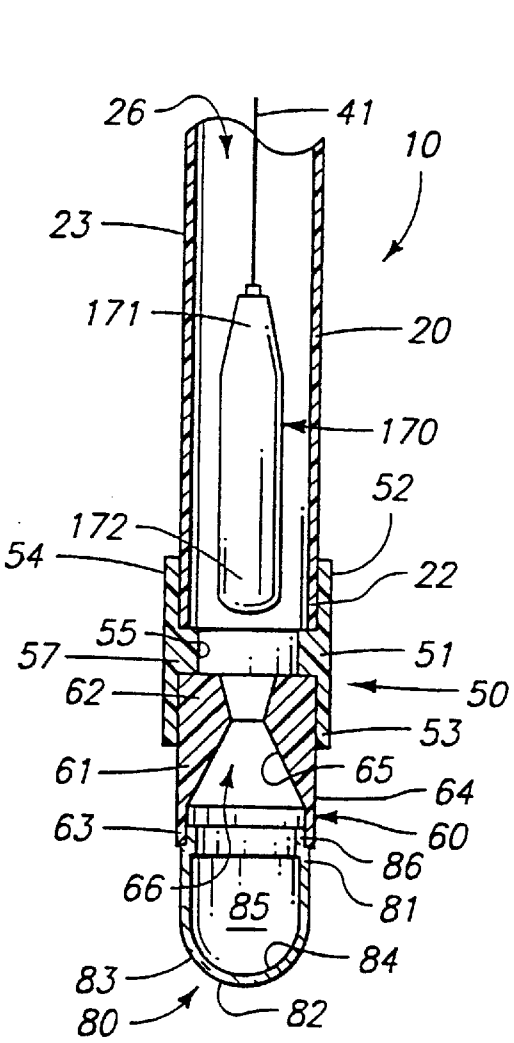
FIG. 8 is a longitudinal, transverse, vertical sectional view of the monitoring well of the present invention, and a seventh type of geophysical or hydrogeologic monitoring device employed with same.

A seventh type of geophysical or hydrogeologic monitoring device is shown in FIG. 8, and includes a soil moisture detection assembly 170. The seventh type of device has a first end 171, which is electrically coupled to the electrical conduit 41, and an opposite second end 172, which is suspended in the conduit 20, and located in close proximity to the distal end 22 thereof.

The various geophysical or hydrogeologic monitoring devices described herein are all operable to sense or otherwise identify various fluids which move from the surrounding earthen layer through the porous housing 80 and into the chamber 85 thereof. Further, this same assembly may be used to sense soil moisture potential, as in the nature of a tensiometer, and wherein water would move from the chamber into the surrounding soil as was discussed earlier.

OPERATION

The operation of the described embodiment of the present invention is believed to be readily apparent and is briefly summarized at this point.

As best seen by reference to FIG. 1, monitoring well 10 of the present invention comprises a conduit 20 defining a passageway 26, the conduit having a proximal end 21, and an opposite distal end 22; a coupler 60 is connected in fluid flowing relationship with the passageway 26; and a porous housing 80 is borne by the coupler 60 and connected in fluid flowing relation thereto.

Another aspect of the present invention relates to a monitoring well 10 for determining soil conditions in below-grade earthen soil 12 comprising a conduit 20 having proximal and distal ends 21 and 22, respectively, and defining a passageway 26 which extends between the proximal and distal ends; a coupler 60 connected in fluid flowing relation relative to the distal end 22 of the conduit 20, the coupler 60 defining a passageway 66, which is disposed in fluid communication with the passageway defined by the conduit; a sleeve disposed intermediate the coupler 60 and the conduit 20, the sleeve 50 having a first end 52 which telescopingly receives the distal end of the conduit, and a second end 53 which telescopingly receives the coupler 60; and a porous housing 80 borne by the coupler 60 and connected in fluid flowing relation relative thereto.

Still a further aspect of the present invention relates to a monitoring well 10 for determining soil conditions in below-grade earthen soil 12 comprising a substantially uniformly linear conduit 20 having proximal and distal ends 21 and 22 respectively, a portion of the conduit including the distal end buried in the below-grade earth and the proximal end being accessible from a location above-grade, the conduit 20 disposed in a substantially nonhorizontal orientation; a sleeve 50 borne on the distal end of the conduit, the sleeve having a first end 52 which telescopingly receives the distal end 22 of the conduit 20, and an opposite second end 53; a coupler 60 telescopingly cooperating with the second end 53 of the sleeve 50, the coupler defining a passageway 66 having a first, and an opposite second end 62 and 63, respectively, and wherein the inside diametral dimension of the first end 67 has a given dimension, and the inside diametral dimension of the second end 68 has a given dimension which is greater than the first end, and wherein the passageway intermediate the first and second ends has an increasing diametral dimension when measured at intervals extending from the first to the second end; a geophysical monitoring device 100 having a connector 113, and which is dimensioned for slidable receipt in the passageway 26 which is defined by the conduit 20, the geophysical monitoring device 100 inserted at the proximal end 21 of the conduit 20 and moving under the influence of gravity along the conduit 20, and in the direction of the distal end 22, the connector 113 moving into mating, fluid flowing cooperation with the coupler 60; and a porous housing 80 telescopingly cooperating with the second end 63 of the coupler 60, and disposed in direct contact with the below-grade earthen soil.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A monitoring well comprising:

a conduit defining a passageway, the conduit having a proximal end, and an opposite distal end;

a coupler connected in fluid flowing relationship with the passageway, and wherein the coupler defines a passageway which has a first end, and an opposite second end, and wherein the second end has a given diametral dimension; and a porous housing borne by the coupler and connected in fluid flowing relation relative thereto, and wherein the porous housing telescopingly mates with the second end.

2. A monitoring well as claimed 1, wherein the coupler has first and second ends, and a passageway extends between the first and second ends, and wherein the passageway includes a reservoir area disposed intermediate the first and second ends.

3. A monitoring well as claimed in claim 1, wherein the connector includes a resilient member which fluid sealably engages the coupler.

4. A monitoring well comprising:

a conduit defining a passageway, the conduit having a proximal end, and an opposite distal end, and wherein the conduit has a given inside diametral dimension;

a coupler connected in fluid flowing relationship with the passageway;

a geophysical monitoring device slidably received in the passageway which is defined by the conduit and oriented in fluid flowing communication with the coupler; and a porous housing borne by the coupler and connected in fluid flowing relation relative thereto.

5. A monitoring well comprising:

a conduit defining a passageway, the conduit having a proximal end, an opposite distal end, and a given inside diametral dimension;

a coupler connected in fluid flowing relationship with the passageway;

a geophysical monitoring device dimensioned for slidable movement in the passageway which is defined by the conduit, and wherein the geophysical monitoring device has a connector for releasable mating cooperation with the coupler; and a porous housing borne by the coupler and connected in fluid flowing relation relative thereto.

6. A monitoring well comprising:

a conduit defining a passageway, the conduit having a proximal end, and an opposite distal end;

a coupler connected in fluid flowing relationship with the passageway;

a sleeve defining a passageway, and wherein the sleeve has a first end which telescopingly receives the distal end of the conduit, and a second end which telescopingly receives the coupler; and a porous housing borne by the coupler and connected in fluid flowing relation relative thereto.

7. A monitoring well comprising:

a conduit defining a passageway, the conduit having a proximal end and an opposite distal end;

a coupler connected in fluid flowing relationship with the passageway, and wherein the coupler is made integral with the conduit and has opposite first and second ends and a passageway extends between the first and second ends, and wherein the diametral dimension of the passageway, at the first end, has a given dimension, and the diametral dimension of the passageway, at the second end, has a dimension which is greater than the first end, and wherein the passageway intermediate the first and second ends has an increasing diametral dimension when measured in a direction extending from the first to the second end; and a porous housing borne by the coupler and connected in fluid flowing relation relative thereto.

8. A monitoring well comprising:

a conduit defining a passageway, the conduit having a proximal end, an opposite distal end, and a given inside diametral dimension;

a coupler connected in fluid flowing relationship with the passageway;

a geophysical monitoring device dimensioned for slidable movement in the passageway of the conduit, and wherein the geophysical monitoring device has a connector for releasable mating cooperation with the coupler;

a guide member releasably affixed on the geophysical monitoring device and telescopingly received in the passageway which is defined by the conduit; and a porous housing borne by the coupler and connected in fluid flowing relation relative thereto.

9. A monitoring well comprising:

a conduit defining a passageway, the conduit having a proximal end, and an opposite distal end;

a coupler connected in fluid flowing relationship with the passageway defined by the conduit;

a sleeve defining a passageway, and wherein the sleeve has a first end which telescopingly receives the distal end of the conduit, and a second end which telescopingly receives the coupler;

a geophysical monitoring device slidably received in the passageway defined by the conduit, and oriented in fluid flowing communication with the coupler; and a porous housing borne by the coupler and connected in fluid flowing relation relative thereto.

10. A monitoring well as claimed in claim 9, wherein the geophysical monitoring device has a connector for mating cooperation with the coupler, and wherein a guide member is releasably affixed on the geophysical monitoring device and telescopingly received in the passageway defined by the conduit.

11. A monitoring well comprising:

a conduit having a proximal and a distal end, and defining a passageway which extends between the proximal and distal ends;

a coupler connected in fluid flowing relation relative to the distal end of the conduit, the coupler defining a passageway which is disposed in fluid communication with the passageway defined by the conduit;

a sleeve disposed intermediate the coupler and the conduit, the sleeve having a first end which telescopingly receives the distal end of the conduit, and a second end which telescopingly receives the coupler; and a porous housing borne by the coupler and connected in fluid flowing relation relative thereto.

12. A monitoring well as claimed in claim 11, wherein the passageway of the conduit has a given inside diametral dimension; and a geophysical monitoring device is slidably received in the passageway which is defined by the conduit, and oriented in fluid flowing communication with the coupler.

13. A monitoring well as claimed in claim 11, wherein the passageway of the conduit has a given inside diametral dimension; and a geophysical monitoring device is dimensioned for slidable movement in the passageway which is defined by the conduit, and wherein the geophysical monitoring device has a connector for releasable mating cooperation with the coupler.

14. A monitoring well as claimed in claim 11, wherein the coupler has a first and second end, and the passageway defined by the coupler extends between the first and second ends, and wherein the diametral dimension of the passageway at the first end has a given dimension, and the diametral dimension of the passageway at the second end has a dimension which is greater than the first end, and wherein the passageway intermediate the first and second ends has an increasing diametral dimension when measured in a direction extending from the first to the second end.

15. A monitoring well as claimed in claim 11, wherein the coupler has first and second ends, and the passageway of the coupler extends between the first and second ends, and wherein the passageway includes a reservoir area disposed intermediate the first and second ends.

16. A monitoring well as claimed in claim 11, wherein the passageway of the conduit has a given inside diametral dimension; and a geophysical monitoring device is dimensioned for slidable movement in the passageway defined by the conduit, and wherein the geophysical monitoring device has a connector for releasable mating cooperation with the coupler, and wherein a guide member is releasably affixed on the geophysical monitoring device and telescopingly received in the passageway defined by the conduit.

17. A monitoring well as claimed in claim 11, and further comprising a geophysical monitoring device slidably received in the passageway defined by the conduit.

18. A monitoring well comprising:

a substantially uniformly linear conduit having proximal and distal ends, and defining a passageway which extends between the proximal and distal ends, and wherein the conduit disposed in a substantially nonhorizontal orientation;

a sleeve borne on the distal end of the conduit, the sleeve having a first end which telescopingly receives the distal end of the conduit, and an opposite, second end;

a coupler telescopingly cooperating with the second end of the sleeve, the coupler defining a passageway having a first, and an opposite second end, and wherein the inside diametral dimension of the passageway at the first end has a given dimension, and the inside diametral dimension at the second end has a given dimension which is greater than the first end, and wherein the passageway intermediate the first and second ends has an increasing diametral dimension when measured in a direction extending from the first to the second ends;

a geophysical monitoring device having a connector, and which is dimensioned for slidable receipt in the passageway defined by the conduit, the geophysical monitoring device inserted at the proximal end of the conduit and moving under the influence of gravity along the conduit and in the direction of the distal end, the connector moving into fluid flowing cooperation with the coupler; and a porous housing telescopingly cooperating with the second end of the coupler.

19. A monitoring well as claimed in claim 18, wherein the connector comprises a natural or synthetic resilient member which fluid sealably engages the first end of the passageway defined by the coupler.

20. A monitoring well as claimed in claim 18, wherein the monitoring device is selected from the group comprising, thermocouple psychrometers, advective vapor sampling assemblies, vapor sampling devices, moisture sampling devices; and pressure sensing devices.

* * * * *